US007634402B2

(12) United States Patent
Lee et al.

(10) Patent No.: US 7,634,402 B2
(45) Date of Patent: Dec. 15, 2009

(54) APPARATUS FOR CODING OF VARIABLE BITRATE WIDEBAND SPEECH AND AUDIO SIGNALS, AND A METHOD THEREOF

(75) Inventors: Mi-Suk Lee, Daejeon (KR); Do-Young Kim, Daejeon (KR); Hong-Kook Kim, Suwon (KR); Seungho Choi, Seoul (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 913 days.

(21) Appl. No.: 10/967,045

(22) Filed: Oct. 14, 2004

(65) Prior Publication Data

US 2005/0108009 A1 May 19, 2005

(30) Foreign Application Priority Data

Nov. 13, 2003 (KR) ..... 10-2003-0080225

(51) Int. Cl.
*G10L 19/02* (2006.01)

(52) U.S. Cl. ..... 704/229

(58) Field of Classification Search ..... 704/229
See application file for complete search history.

(56) References Cited

U.S. PATENT DOCUMENTS 5,109,417 A * 4/1992 Fielder et al. ..... 704/205
5,752,225 A * 5/1998 Fielder ..... 704/229
5,778,335 A * 7/1998 Ubale et al. ..... 704/219
2004/0062234 A1 * 4/2004 LeBlanc et al. ..... 370/352

FOREIGN PATENT DOCUMENTS

| | | |
|---|---|---|
| EP | 1202252 | 10/2001 |
| JP | 2002-016925 | 1/2002 |
| WO | WO 03/042981 A1 | 5/2003 |

OTHER PUBLICATIONS

Mixed wideband speech and music coding using a speech/music discriminator Rong-Yu Iao, "Mixed wideband speech and music coding using a speech/music discriminator",Proceedings of IEEE TENCON '97. IEEE Region 10 Annual Conference. Speech and Image Technologies for Computing and Telecommunications', vol. 2, Dec. 2-4, 1997 pp. 605-608 vol. 2.*

(Continued)

*Primary Examiner*—David R Hudspeth
*Assistant Examiner*—Jakieda R Jackson
(74) *Attorney, Agent, or Firm*—Blakely, Sokoloff, Taylor & Zafman LLP

(57) ABSTRACT

An apparatus for coding of variable bitrate wideband speech and audio is described. The apparatus utilizes: a) a speech and audio divider for dividing signals inputted to a CODEC into speech or audio signals; b) a narrowband coder for performing narrowband coding, in the case the divided input signals are speech signals; c) a bitrate modifier for modifying a bitrate for coding of low frequency band and a bitrate for coding of a high frequency band, in the case the divided input signals are audio signals; and d) a wideband coder for performing coding by the modified bitrate in the bitrate modifier.

8 Claims, 5 Drawing Sheets

OTHER PUBLICATIONS

Purnhagen, H. et al, "HILN-The MPEG-4 paramteric audio coding tools", The 2000 IEEE International Symposium on Circuits and Systems, 2000. Proceedings. ISCAS 2000 Geneva. vol. 3, May 28-31, 2000 pp. 201-204 vol. 3.*

Ramprashad, S.A., "A multimode transform predictice coder (MTPC) for speech and audio", IEEE Workshop on Speech Coding Proceedings, 1999, Jun. 20-23, 1999 pp. 10-12.*

"A Bitrate and Bandwidth Scalable Celp Coder", T. Nomura, et al., 1998 IEEE, Jun. 1998, pp. 341-344.

* cited by examiner

| | frequency range (Hz) | sampling speed (kHz) | PCM bit/sample | bitrate (kbps) |
|---|---|---|---|---|
| telephone speech | 300~3,400 | 8 | 8 | 64 |
| wideband speech | 50~7,000 | 16 | 14 | 224 |
| wideband audio | 20~20,000 | 44.1 | 16 | 705.6 |

FIG.2

| Standard | G.722 | G.722.1 | G.722.2 |
|---|---|---|---|
| Date | 1988 | 1999 | 2001 |
| bitrate(kbps) | 48, 56, 64 | 24, 32 | 23.85.~6.6 |
| delay(ms) | 1.625 | 40 | 25 |
| complexity | 10 MIPS | <15 MIPS | 38 VMOPS |
| Quality | Commentary | 24 ≥ G.722(56)<br>32 ≥ G.722(64) | 15.85 ≥ G.722(56)<br>23/05 ≥ G.722(64) |

APPARATUS FOR CODING OF VARIABLE BITRATE WIDEBAND SPEECH AND AUDIO SIGNALS, AND A METHOD THEREOF

CROSS REFERENCE TO RELATED APPLICATION

This application claims priority to and the benefit of Korea Patent Application No. 2003-80225 filed on Nov. 11, 2003 in the Korean Intellectual Property Office, the entire content of which is incorporated herein by reference.

BACKGROUND OF THE INVENTION (a) Field of the Invention

The present invention relates to an apparatus for coding variable bitrate wideband speech and audio signals, and a method thereof. More specifically, the present invention relates to an apparatus for coding variable bitrate wideband speech and audio signals, and a method thereof for dividing speech and audio signals and transmitting the signals with an efficient bitrate in variable bit rate wideband speech and audio coding.

(b) Description of the Related Art

First, a general speech coding technique is disclosed. Although a bandwidth of human speech frequency is 50~7000 Hz, in the speech coding techniques, 300~3400 Hz is legibly used as a speech bandwidth of human, and the speech signal is sampled at 8 kHz, in consideration of a guard band.

Waveform coding, sound source coding, and hybrid coding are known as methods for coding speech signals to digital signals. PCM(G.711), ADPCM(G.721), SB-ADPCM (G.722), LD-CELP(G.728), CS-ACELP(G.729), MP-MLQ (G.723.1) etc. are known as main techniques thereof.

The G.711 reference is a method of speech coding using a 64 kbps PCM technique, which is a method recommended by ITU-T in 1972. The PCM is a method sampling, quantizing, and coding analog speech signals to digital signals and transmitting the digital signals, and decoding the digital signals to analog speech signals. The PCM uses a nonlinear quantizing technique for compressing speech signals before quantization as well as for decompressing the speech signals after decoding.

Further, the G.721 reference is a method of coding and compressing speech using a 32 kbps ADPCM technique, which was recommended by ITU-T in 1984. The ADPCM is a method of quantizing the difference of input signals and estimated values obtained by using a large correlation of speech signals in time to reduce the transmission bitrate. The ADPCM provides almost the same quality of sound as the PCM by using an adaptation quantizer and an adaptation predictor.

Further, the G.722 reference is a method of coding a wideband speech signal whose bandwidth is ranging from 50 Hz to 7 kHz and achieves a high quality with a bitrate of below 64 kbps, which was recommended by ITU-T in 1986. The subband-ADPCM method used in G.722 separates speech signals into two bands: a low frequency band of 0~4 kHz and a high frequency band of 4~8 kHz, processes speech signals according to ADPCM, and multiplexes the signals to transmit the signals at 64 kbps. The subband-ADPCM is applied to a multimedia communication conference for supplementing a speech conference.

Further, the G.728 reference is a method of speech coding which can obtain better sound quality than the G.721, where speech is coded at 16 kbps for low speed mobile communication, and was recommended by ITU-T in 1992. The LD-CELP (Low Delay-Code Excited Linear Prediction) method transfers only 10 bits of which 5 samples of speech signals are regarded as 1 frame, and achieves high quality of sound treated with a vector unit in 2 ms coding delay.

Further, the G.729, CS-ACELP, reference is coded at 8 kbps and achieves better sound quality than the G.721. Here, CS-ACELP is an abbreviation for Conjugate Structure-Algebraic Code Excited Linear Prediction.

Further, the G 723.1 reference is coded at 6.3 kbps or 5.3 kbps but achieves almost equivalent for 6.3 kbps MP-MLQ (Multi Pulse Multi Level Quantization) or poorer speech quality for 5.3 kbps ACELP than the G.721. It was recommended by ITU-T in 1995 and has been used as a standard speech coder for multimedia communications services.

A detailed comparison for the above methods is shown in Table 1.

TABLE 1

| Reference | Method of compression | Speed | MOS | Application |
|---|---|---|---|---|
| G.711 | PCM | 64 kbps | 4.1 | Digital transferring between central offices |
| G.721 | ADPCM | 32 kbps | 3.85 | CODEC in home or enterprise |
| G.722 | SB-ADPCM | 64 kbps | (audio signal) | Multimedia speech conference, AM broadcast graded sound quality |
| G.728 | LD-CELP | 16 kbps | 3.61 | Digital mobile communication, ISDN, FR network for speech |
| G.729 | CS-ACELP | 8 kbps | 3.92 | H.323, H.320, video conference, terminal mobile communication, FR network for speech |
| G.723.1 | MP-MLQ<br>ACELP | 6.3 kbps<br>5.3 kbps | 3.9<br>3.65 | Mobile communication, H.324 etc., video conference terminal mobile, VOIP form |

FIG. 1*a* and FIG. 1*b* are diagrams for explaining division of speech signals into telephone speech, wideband speech, and wideband audio (or music). As shown in FIGS. 1*a* and 1*b*, narrowband speech of 300~3,400 Hz may not express a significant high frequency component, wideband speech of 50~7,000 Hz provides better sound quality than that of the narrowband, and wideband audio of 20~20,000 Hz can provide music with the quality of CDs (Compact Discs) or DATs (Digital Audio Tapes).

FIG. 2 is a diagram for explaining types of general ITU-T wideband speech coders. The G.711 reference, G.723.1 reference, and G.729 reference etc. are applied to a narrowband speech CODEC, and the G.722, G.722.1 or G.722.2 reference are applied to a wideband speech CODEC as shown in FIG. 2.

Meanwhile, EP 1202252A2 applied by NEC Corporation of Feb. 5, 2002 discloses "Apparatus for bandwidth expansion of speech signals," which relates to an apparatus for deciding a decoding method between narrowband speech signals and wideband speech signals based on coding parameters inputted to a CODEC, and coding the signals according to a result of the decision.

More specifically, the EP1202252A2 discloses a method dividing input signals into narrowband and wideband, and decoding the divided input signals suitably to their bandwidth in narrowband and wideband. If necessary, the invention decodes speech signals to wideband and improves quality of sound in a decoder. Here, the decision of bandwidth is made by using excited signals generated from LSPs (Line Spectral Pairs), an adaptive codebook, and a fixed codebook.

Meanwhile, Toshiyuki Nomura et al. reported a document "A bitrate and bandwidth scalable CELP coder" to the International Conference on Acoustics, Speech, and Signal Processing (Vol. 1, pp 341-344) in May 1998, which relates to an adaptable CELP-type speech CODEC allowing a bitrate and a bandwidth variable for a multimedia application, and discloses a method allowing a variable bitrate by using a coding method of a multilevel excited signal.

More specifically, according to the document, a variable bandwidth is achieved by coding a high frequency band parameter using CELP parameter information of a low frequency band, and the document provides a 16 kbit/s coder showing the same quality of sound as ITU-T 56 kbit/s G. 722 resulting from a Mean Opinion Sore (MOS) Test. According to this document, multilevel excited signals are coded by using a bitrate variable tool, low frequency band parameter information is used by a bandwidth variable tool, and a bitrate is adaptively controlled depending on circumstances of a communication network.

Meanwhile, for example, "Code-excited linear prediction: High quality speech at very low bit rates" (Proc. ICASSP, pp. 937-940, 1985) by M. Schroeder and B. Atal, and "Improved speech quality and efficient vector quantization in SELP" (Proc. ICASSP, pp. 155-158, 1988) by Kleijn et al. disclose CELP (Code Excited Linear Predictive Coding) which is known as a method for coding speech signals with high efficiency.

First, the CELP discloses extracting a spectrum parameter showing spectrum properties of speech signals per each frame of speech signals (for example, per 20 ms) by using a LPC (Linear Predictive Coding) analysis. Next, each frame is further divided into sub-frames (for example, 5 ms). The parameters for an adaptive codebook (delay parameter and gain parameter responding to pitch cycle) are extracted per sub-frame on the basis of past sound source signals for predicting speech signals of a sub-frame from the adaptive codebook over a long period.

Next, the most suitable sound source code vector is selected from a sound source codebook (a vector-quantizing codebook) constituted by the predetermined kinds of noise signals, the most suitable gain is calculated, and then the sound source signals obtained from the long period prediction are quantized. Further, with respect to the selection of the sound source code vector, the sound source code vector is selected to minimize an error power between signals composed of the selected noise signals and residual signals.

Then, an index showing types of the selected sound source code vector; a gain and a spectrum parameter; and a parameter of the adaptive code book are multiplexed by a multiplexer, and transferred.

Meanwhile, in the conventional method for coding speech signals as described above, for selecting the most suitable sound source code vector from the sound source codebook, it is needed to calculate a filtering or convolution operation for each code vector, and the operation needs to be performed repeatedly as many as the number of vector codes stored in the codebook, and therefore numerous operations are needed. For example, in case the number of the bit of a sound sourcebook is B bits, and the dimension of the code vector is N, assuming that a filter or response length is K at a filtering or convolution operation, $N \times K \times 2^B \times 8000/N$ operations are needed. In the case B=10, N=40, K=10, a huge number of operations of 81,920,000 per second is needed.

Thus, various methods have been suggested for reducing the number of operations which are needed to search a sound source code vector from the sound source codebook. For example, the ACELP (Algebraic Code Excited Linear Prediction) method, which is one of them, is disclosed in a document entitled "16 kbps wideband speech coding technique based on algebraic CELP" (Proc. ICASSP, pp. 13-16, 1991) by C. Laflamme et al.

In the ACELP method, sound source signals are expressed as a plurality of pulses, and a location of each pulse is indicated with the predetermined number of bits and they are transferred. Since the amplitude of each pulse is limited to +1 or −1, the number of operations for searching the pulse can be significantly reduced.

However, in the conventional method for coding speech signals as described above, satisfactory quality of sound can be obtained from speech signals with a coding bitrate over 8 kbit/s. Meanwhile, when a coding bitrate becomes less than 8 kbit/s, the number of pulses per sub-frame is not sufficient, so it is difficult to express sound source signals with sufficient accuracy. Thus, there is a problem that loss of sound quality occurs with coded speech.

Most apparatuses for coding of variable bitrate wideband speech and audio use a variable bandwidth method, which modifies a bitrate in narrowband or wideband; or modifies only the bandwidth.

That is, in a speech CODEC according to the conventional method, modification of the bitrate is achieved by controlling bits assigned to the inside of the narrowband or the wideband according to parameters of each CODEC, in consideration of a channel state or control of the CODEC. Further, the bitrate can be modified by simply adjusting the bandwidth such as from narrowband to wideband or from wideband to narrow band.

Further, in the case input signals are audio signals having significant information in a high frequency band, and only a low frequency band or a narrow band is coded and transferred, the bitrate modification method can cause a problem by limitation of a low bitrate. That is, the bitrate modification method excludes audio signals including music signals or natural sounds etc. in coding, so as to cause loss of sound quality.

SUMMARY OF THE INVENTION

The advantage of the present invention provides an apparatus for coding of variable bitrate wideband speech and audio, and a method thereof, which can minimize loss of sound quality by assigning bits for coding to the high frequency band even at a low bitrate.

In one aspect of the present invention, an apparatus for coding of variable bitrate wideband speech and audio according to the present invention comprises: a) a speech and audio divider for dividing signals inputted to a CODEC into speech or audio signals; b) a narrowband coder for performing narrowband coding, in the case the divided input signals are speech signals; c) a bitrate modifier for modifying a bitrate for coding of a low frequency band and a bitrate for coding of a high frequency band, in the case the divided input signals are audio signals; and d) a wideband coder for performing coding by the modified bitrate in the bitrate modifier.

Here, the bitrate modifier modifies a bitrate of a low frequency band and a bitrate of a high frequency band with respect to the input audio signals of a low bitrate.

Here, the wideband coder takes some bits assigned to the low frequency band for coding and assigns them to the high frequency band for coding.

In another aspect of the present invention, a method for coding of variable bitrate wideband speech and audio according to the present invention comprises: i) analyzing input signals inputted to a CODEC and dividing the input signals into speech or audio signals; ii) assigning bits to only a low frequency band and performing coding in the case the divided input signals are speech signals; iii) modifying a bitrate of a low frequency band and a bitrate of a high frequency band, in the case the divided input signals are audio signals; iv) assigning bits to the low frequency band and the high frequency band by the modified bitrate and performing coding.

The coding in ii) is speech oriented narrowband coding.

The coding in iv) is audio oriented wideband coding.

The wideband coding takes some bits assigned to the low frequency band and assigns them to the high frequency band for coding.

Meanwhile, a recording medium for storing a program readable by a computer according to the present invention stores the program that performs coding of variable bitrate wideband speech and audio. The program comprises: i) analyzing input signals inputted to a CODEC and dividing the input signals into speech or audio signals; ii) assigning bits to only a low frequency band and performing coding in the case the divided input signals are speech signals; iii) modifying a bitrate of the low frequency band and a bitrate of a high frequency band, in the case the divided input signals are audio signals; iv) assigning bits to the low frequency band and the high frequency band by the modified bitrate and performing coding.

According to the present invention, in the design of an apparatus for coding of variable bitrate wideband speech, the present invention relates to a variable bitrate and variable bandwidth (or modification of bandwidth) depending on a state of a channel. The present invention analyzes input signals and divides the input signals into speech or audio signals, and modifies a bitrate assigned to coding of a low frequency band and coding of a high frequency band. Thus, a component of the high frequency band may or may not be included, and audio signal information may not be lost in the case that a bitrate is reduced. Thus the quality of sound can be improved at a low bitrate.

BRIEF DESCRIPTION OF THE DRAWINGS

The accompanying drawings, which are incorporated in and constitute a part of the specification, illustrate an embodiment of the invention, and, together with the description, serve to explain the principles of the invention:

FIG. 2 shows an explanation for types of a general ITU-T speech coder.

DETAILED DESCRIPTION OF THE PREFERRED EMBODIMENTS

Figures 1A, 1B:
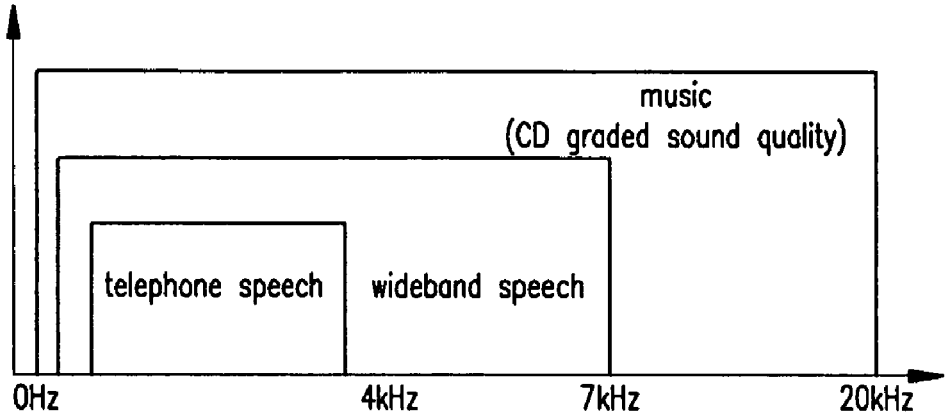
FIGS. 1*a* and 1*b* show that sound signals are divided into telephone speech, wideband speech, and wideband audio or music.

In the following detailed description, only the preferred embodiment of the invention has been shown and described, simply by way of illustration of the best mode contemplated by the inventor(s) of carrying out the invention. As will be realized, the invention is capable of modification in various obvious respects, all without departing from the invention. Accordingly, the drawings and description are to be regarded as illustrative in nature, and not restrictive. To clarify the present invention, parts which are not described in the specification are omitted, and parts for which similar descriptions are provided have the same reference numerals.

Hereinafter, an apparatus for coding of variable bitrate wideband speech and audio signals and a method thereof according to the exemplary embodiment of the present invention are described in detail with reference to the appended drawings.

First, the present invention desires to efficiently perform changing a bitrate of a variable bitrate wideband speech coder to improve its performance in the next generation network or multimedia service. To achieve this advantage, the present invention includes dividing input signals into speech signals or audio signals, and constructing a CODEC in order to modify a bit for coding in a low frequency band and a high frequency band based on the above division. Thus, loss of sound quality in the audio signals is reduced. In this case, a bit for coding assigned to the narrowband is taken, and some bits taken in the narrowband are assigned to the wideband for coding.

Figure 3:
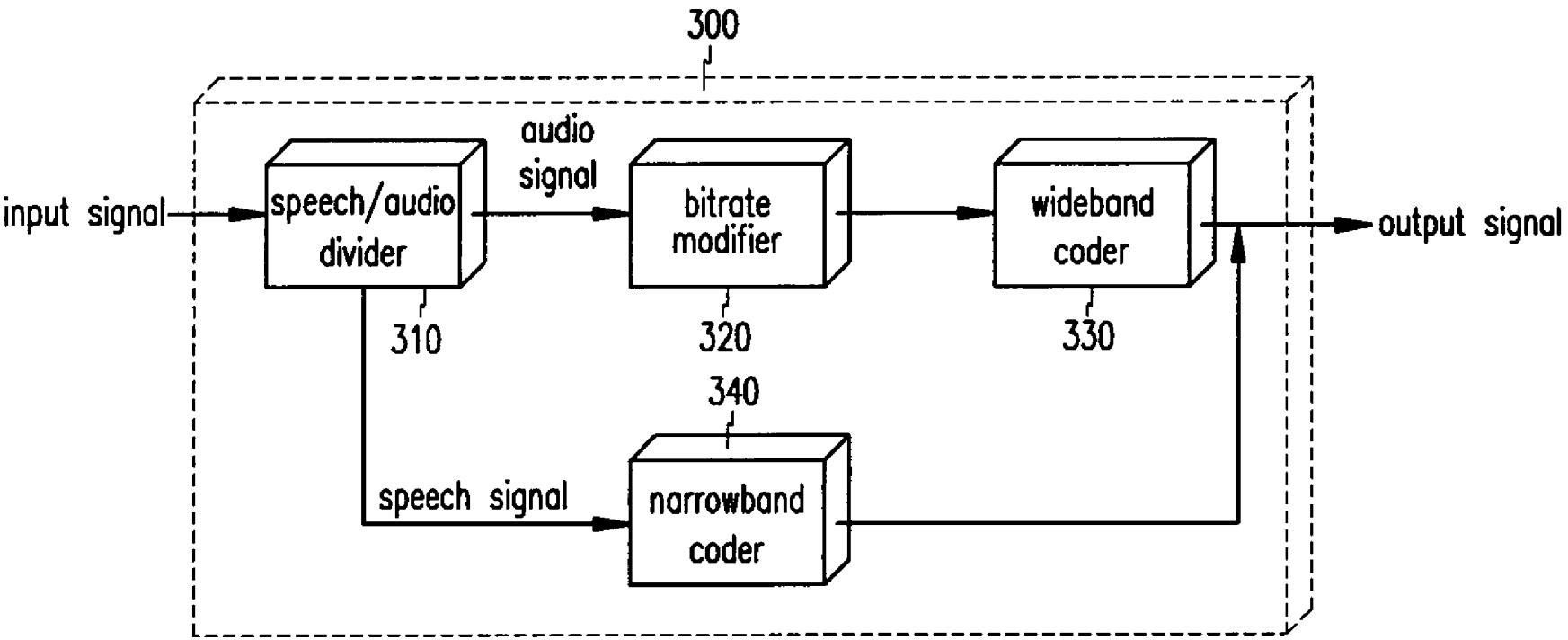
FIG. 3 shows a brief construction diagram of an apparatus for coding of variable bitrate wideband speech and audio signals according to the present invention.

FIG. 3 shows a brief construction diagram of an apparatus for coding of variable bitrate wideband speech and audio signals according to a preferred embodiment of the present invention. The apparatus for coding of wideband speech and audio signals 300 comprises: a speech and audio signal divider 310 for dividing signals input to a CODEC into speech and audio signals; a narrowband coder 340 for performing narrowband coding when the divided input signals are speech signals; a bitrate modifier 320 for modifying a bitrate of coding of a low frequency band and a high frequency band when the divided input signals are audio signals; and a wideband coder 330 for performing coding by the modified bitrate in the bitrate modifier.

As referred to in FIG. 3, the CODEC of the present invention for coding audio signals includes the speech and audio signal divider 310 for dividing signals input to a CODEC into speech and audio signals; and a bitrate modifier 320 for modifying a bitrate of coding a low frequency band and a high frequency band based on the division.

That is, when the input signals are audio signals, the wideband coder 330 performs coding and takes an amount of bits assigned to the low frequency band, and assigns some bits taken to the high frequency band. When the input signals are speech signals, the narrowband coder 340 performs coding of only speech signals. In other words, the bitrate modifier 320 modifies the bitrate of the low frequency band and high frequency band for input audio signals of a low bitrate, and the wideband coder 330 takes some bits for coding assigned to the low frequency band and assigns them to the high frequency band for coding.

Figure 4:
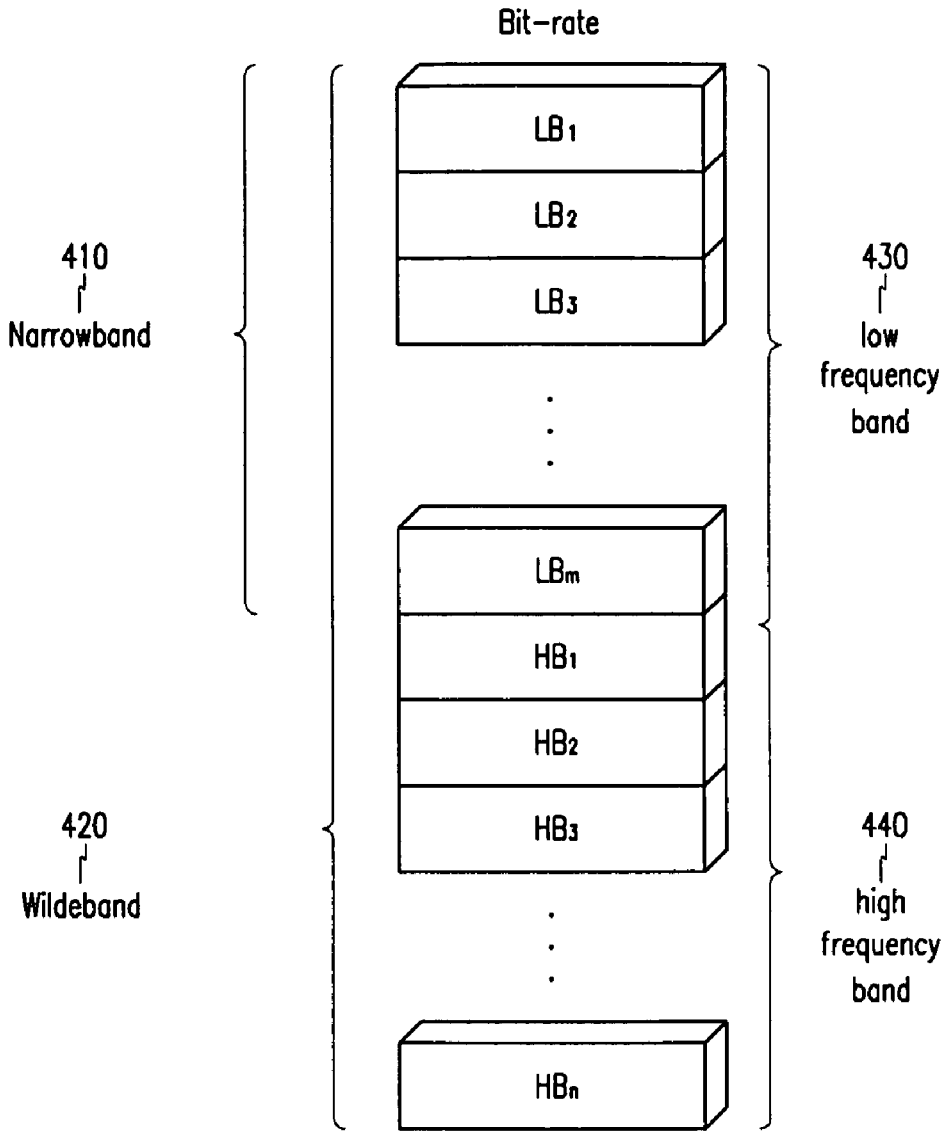
FIG. 4 shows a method for assigning bitrates to narrowband and wideband according to the present invention.

FIG. 4 shows a method for assigning a bitrate to narrowband and wideband according to the present invention. The method for assigning the bitrate to the narrowband 410 and the wideband 420, that is, the method for separately assigning the bitrate to the low frequency band and high frequency band by the low bitrate, is explained with reference to FIG. 4.

When the input signals are the speech signals in FIG. 3, the bitrates are sequentially summed up from a low frequency band bitrate ($LB_1$). That is, the bitrate is modified as $LB_1+LB_2+\ldots+LB_M$. On the other hand, in the case the input signals are the audio signals, the bitrate of $LB_1+LB_2+\ldots+LB_k$ ($k<M$) is assigned to the low frequency band 430, and the bitrate of $LB_k+\ldots+LB_M$, from the $k+1^{th}$ bitrate ($LB_{k+1}$) to the $m^{th}$ bitrate ($LB_M$) of low frequency band 430 are assigned to the high frequency band 440, to which the bitrate of $HB_1 + \ldots + HB_n$ (n<N) is assigned to. That is, some of the bits of the low frequency band are assigned to the high frequency band.

Figure 5:
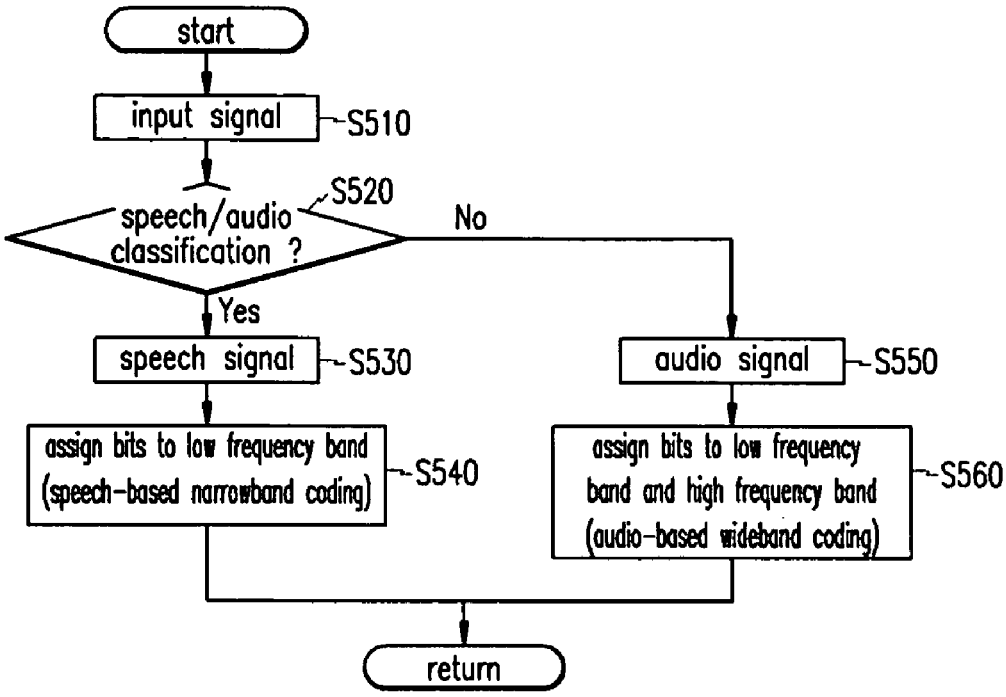
FIG. 5 shows a flow chart for a method for coding of variable bitrate wideband speech and audio signals.

FIG. 5 shows a flow chart for a method for coding of variable bitrate wideband speech and audio signals.

In the method for coding of variable bitrate wideband speech and audio signals, first signals received to the CODEC are inputted (S510), then the signals inputted to the CODEC are divided into speech signals or audio signals (S520). That is, it is determined whether audio signals such as music or natural sound are included in a high frequency band, which can affect the quality of sound, and the input signals are divided into speech and audio signals based on the determination.

Next, When the divided input signals are the speech signals (S530), bits are assigned to the low frequency band, and the coding is performed (S540). Here, the coding is speech-oriented narrowband coding, which uses the same method as the conventional method for coding speech.

Next, in the case the divided input signals are audio signals (S550), a bitrate of coding of a low frequency band and a high frequency band are modified respectively. Then, bits are assigned to the low frequency band and the high frequency band, and the coding is performed (S560). Here, the coding is audio-oriented wideband coding, the wideband coding takes some bits assigned to the low frequency band and assigns them to the high frequency band for coding.

While this invention has been described in connection with what is presently considered to be the most practical and preferred embodiment, it is to be understood that the invention is not limited to the disclosed embodiments, but, on the contrary, is intended to cover various modifications and equivalent arrangements included within the spirit and scope of the appended claims.

According to the present invention, the apparatus for coding of variable bitrate wideband speech can prevent loss of sound quality even if audio signals are included in the input signals, by assigning bits for coding to the high frequency band even at a low bitrate.

Further, according to the present invention, performance of the apparatus for coding of variable bitrate wideband speech can be improved by modifying the bitrate efficiently.

What is claimed is:

1. An apparatus for coding of variable bitrate wideband speech and audio, comprising: a) a speech and audio divider for dividing signals inputted to a CODEC into speech or audio signals; b) a narrowband coder for performing narrowband coding when the divided input signals are speech signals; c) a bitrate modifier for decreasing a bitrate for coding of a low frequency band and increasing a bitrate for coding of a high frequency band by the amount decreased in the low frequency band when the divided input signals are audio signals; and d) a wideband coder for performing coding by the modified bitrate in the bitrate modifier.

2. The apparatus for coding of variable bitrate wideband speech and audio of claim 1, wherein the bitrate modifier modifies a bitrate of a low frequency band and a bitrate of a high frequency with respect to the input audio signals of a low bitrate.

3. The apparatus for coding of variable bitrate wideband speech and audio of claim 1, wherein the wideband coder takes some bits for coding assigned to the low frequency band and assigns them to a high frequency band for coding.

4. A method for coding of variable bitrate wideband speech and audio comprising: i) determining input signals inputted to a CODEC and dividing the input signals into speech or audio signals; ii) assigning bits to a low frequency band and performing coding in the case the divided input signals are speech signals; iii) modifying a bitrate by decreasing a bitrate for coding of a low frequency band and increasing a bitrate for coding of a high frequency band by the amount decreased in the low frequency band when the divided input signals are audio signals; and iv) assigning bits to the low frequency band and the high frequency band by the modified bitrate and performing coding.

5. The method for coding of variable bitrate wideband speech and audio of claim 4, wherein the coding in ii) is speech oriented narrowband coding.

6. The method for coding of variable bitrate wideband speech and audio of claim 4, wherein the coding in iv) is audio oriented wideband coding.

7. The method for coding of variable bitrate wideband speech and audio of claim 6, wherein the wideband coding takes some bits assigned to the low frequency band and assigns them bits to the high frequency band for coding.

8. A recording medium for storing a program readable by a computer, the program performing coding of variable bitrate wideband speech and audio, the program comprising: i) determining input signals inputted to a CODEC and dividing the input signals into speech or audio signals; ii) assigning bits to a low frequency band and performing coding when the divided input signals are speech signals; iii) modifying a bitrate by decreasing a bitrate for coding of a low frequency band and increasing a bitrate for coding of a high frequency band by the amount decreased in the low frequency band when the divided input signals are audio signals; and iv) assigning bits to the low frequency band and the high frequency band by the modified bitrate and performing coding.

* * * * *